United States Patent [19]

Ehrlich et al.

[11] 4,411,879

[45] Oct. 25, 1983

[54] METHOD FOR ENHANCING THE SULFUR CAPTURE POTENTIAL OF LIME USING A FILTER MEANS IN THE FLUE GAS

[75] Inventors: Shelton Ehrlich, Palo Alto; Callixtus Aulisio, El Granada, both of Calif.

[73] Assignee: Electric Power Research Institute, Palo Alto, Calif.

[21] Appl. No.: 292,646

[22] Filed: Aug. 13, 1981

[51] Int. Cl.[3] ..... C01F 11/02

[52] U.S. Cl. ..... 423/640; 34/9; 110/245; 110/263; 110/342; 110/347; 423/244; 432/15

[58] Field of Search ..... 423/638, 640, 242 A, 423/244 A; 122/4 D; 110/263, 347, 245, 342; 34/9; 432/15

[56] References Cited

U.S. PATENT DOCUMENTS

| | | | |
|---|---|---|---|
| 3,919,394 | 11/1975 | Selmeczi | 423/242 A |
| 3,933,978 | 1/1976 | Margraf | 423/244 A |
| 3,959,441 | 5/1976 | Furuta et al. | 423/242 A |
| 4,147,755 | 4/1979 | Gogineni et al. | 423/242 A |
| 4,178,349 | 12/1979 | Wienert | 423/244 A |
| 4,197,285 | 4/1980 | Yang et al. | 423/638 |
| 4,324,544 | 4/1982 | Blake | 110/347 |
| 4,333,909 | 6/1982 | Stewart et al. | 110/347 |

OTHER PUBLICATIONS

Boynton, *Chemistry and Technology of Lime and Limestone,* Interscience Publishers, (1966), pp. 287–290 and 298–302.

Perry, *Chemical Engineers' Handbook,* Third Edition, McGraw-Hill Book Co., (1950), pp. 1560, 1561.

*Primary Examiner*—O. R. Vertiz
*Assistant Examiner*—Wayne A. Langel
*Attorney, Agent, or Firm*—Flehr, Hohbach, Test, Albritton & Herbert

[57] ABSTRACT

A method is provided for improving the sulfur capture potential of lime in the fluidized bed combustion of coal and for improving the flow characteristics of the feed coal therefor comprising collecting partially sulfated limestone particles from the fly ash of the flue gas from the fluidized bed combustor, and (a) retaining said particles in the flue gas stream, thereby hydrating said particles, and returning said particles to the combustor; or (b) mixing said partially sulfated limestone particles with wet coal thereby drying said coal and simultaneously hydrating unreacted calcium oxide to form calcium hydroxide, and recycling said mixture of dry crushed coal and calcium hydroxide into said fluidized bed combustor; or (c) introducing wet coal in the flue gas upstream from said collected particles, thereby providing moisture to hydrate said particles, and returning said hydrated particles to the combustor.

11 Claims, 7 Drawing Figures

METHOD FOR ENHANCING THE SULFUR CAPTURE POTENTIAL OF LIME USING A FILTER MEANS IN THE FLUE GAS

This invention relates to methods for enhancing the sulfur capture potential of limestone which is used in fluidized bed combustors. The invention is further drawn to methods for drying the wet feed coal for fluidized bed combustors to improve its transport properties.

There is an increasing interest in the use of fluidized bed combustors which consume sulfur-containing carbonaceous fuels to produce heat and electricity. In order to eliminate or reduce the sulfur oxides which are produced during the combustion of such fuels, the fluidized beds contain calcium compounds such as calcium oxide, calcium hydroxide, calcium carbonate and the like to absorb sulfur oxides during combustion. When calcium carbonate is used as a sulfur-capture agent in fluidized beds it has been found that the flue gas contains fly ash comprising coal ash plus calcium sulfate, and calcium oxide. The calcium oxide results from the loss of carbon dioxide from calcium carbonate. It has been observed that when limestone is used as a sulfur absorbent in a conventional wet flue gas desulfurization unit, it is converted almost quantitatively to calcium sulfate and calcium sulfite. However, when limestone is used in a fluidized bed combustor the conversion of limestone to calcium sulfate may be as low as 15%, usually about 30%, but virtually never more than 70%. It is an object of the instant invention to increase the limestone conversion in a fluidized bed combustor to near 100%.

A second problem found in fluidized bed combustors is the feeding of crushed coal into the fluidized bed through tubes in dilute or dense phase pneumatic transport. The problem arises in that the feed coal is prepared by crushing, not by pulverization since pulverization is too costly. The crushed coal for a fluidized bed is therefore not dried as it would have been in a pulverizing process. Thus the crushed feed coal is normally fed into the fluidized bed combustor in a wet state which makes it difficult to feed through relatively small feed tubes. In some designs for fluidized bed combustors a fuel-fired coal dryer is placed upstream of the coal crusher/feeder system. However, the addition of a fired coal dryer detracts from the overall energy efficiency of the power generating system. According to the instant invention, the crushed wet coal is dried by mixing with fly ash which contains calcium oxide. When calcium oxide and wet coal are in contact an exothermic reaction occurs which allows the resulting mixture to be warm, dry and free-flowing. It is therefore another object of the invention to provide dry and free-flowing crushed coal for a fluidized bed combustor without the requirement of an energy consuming coal drying system.

The present invention provides a novel method for improving the sulfur capture potential of limestone in a fluidized bed combustor and for improving the flow characteristics of the crushed coal feed for said combustor.

In a fluidized bed combustor limestone is used to remove $SO_2$ according to the general set of equations:

$$CaCO_3 \xrightarrow{HEAT} CaO + CO_2 \quad (1)$$

$$CaO + SO + \tfrac{1}{2} O_2 \longrightarrow CaSO_4 \quad (2)$$

However, a substantial excess of limestone must be fed into the fluidized bed combustor since normally only 15% to 30% of the limestone is converted to calcium sulfate. It appears that the pores of the calcined limestone become occluded with the relatively large calcium sulfate molecules and the unreacted calcium oxide remains in the interior of the limestone particle. However, if the partially sulfated limestone is removed from the combustor, cooled and hydrated, the pore structure is modified and the reactivity of the remaining calcium oxide increases substantially. For example, in partially sulfated limestone containing calcium oxide and calcium sulfate in a 1:1 ratio, the hydration reaction would be as follows:

$$CaO.CaSO_4 + H_2O \rightarrow Ca(OH)_2.CaSO_4 \quad (3)$$

By controlling the amount of water added to the partially sulfated limestone the desired reaction above (3) may be effected. An excess of water added to the mixture would lead to the further hydration of calcium sulfate according to the following reaction (4), which is no more advantageous in increasing reactivity of the unreacted calcium oxide than is the equation (3) above.

$$CaO.CaSO_4 + 3H_2O \rightarrow [CaSO_4.2H_2O].Ca(OH)_2 \quad (4)$$

It has now been found that the desired hydration reaction (3) may be advantageously and economically effected by mixing partially sulfated limestone from the fluidized bed combustor with crushed wet coal, thereby drying the coal to make it more freely flowing and easily transportable through the feed tubes into the fluidized bed combustor. The method according to the instant invention is therefore efficient in that the sulfur capture potential of the limestone in the fluidized bed is enhanced while at the same time the crushed feed coal is dried without the necessity of adding a fuel fed coal dryer into the system.

According to the instant invention the partially sulfated limestone contained in the fly ash of the flue gas from the fluidized bed combustor is collected by means of dust collectors, such as a fabric filter. This fly ash contains partially sulfated limestone particles as well as ash. The collected dust cake containing calcium oxide is then mixed with wet crushed coal. In order to effect the preferred hydration reaction the coal and calcium oxide are mixed at a temperature from about 200° F. to about 400° F. This may be accomplished without the necessity of an additional heating means since the fly ash will be warm as it is collected from the flue gas. In addition the reaction of water with calcium oxide is exothermic, releasing about 2500 BTU per pound of water reacting with calcium oxide. The mixture of dry coal and hydrated calcium oxide (calcium hydroxide) is easily flowable and therefore may be effectively transported to pipes for feeding into the fluidized bed combustor.

The advantages of the system according to the instant invention are that the efficiency of the limestone conversion to calcium sulfate in the fluidized bed combustor may approach 100% and the crushed wet coal feed for the fluidized bed combustor may be dried without the necessity of an additional fuel-consuming drying step.

In another embodiment of the instant invention the moisture in the wet coal may be indirectly used to hydrate the unreacted calcium oxide. The wet coal may be exposed to the flue gas upstream of the fabric filter or other means which collects the flue gas dust particles. The temperature of the flue gas at the point where the wet coal is exposed to it would be safely below the ignition temperature of the coal so as to preclude the possibility of coal ignition in the event sufficient oxygen to sustain combustion becomes present due to air intrusion. In this modification the evaporated moisture from the wet coal is transported in the flue gas into the fabric filter which contains the dust cake. The hydration reaction then occurs in the dust cake which contains calcium oxide as well as coal fines which enter the flue stream from the crushed coal. The dust cake containing a substantial amount of coal fines and hydrated calcium oxide is freely flowable and recycled into the fluidized bed combustor. Alternatively, this dust cake is mixed with the dry crushed coal and fed into the fluidized bed combustor.

In a further embodiment of the invention all the moisture required to hydrate the calcium oxide is provided by the flue gas which contains water vapor resulting from combustion. Typical water vapor concentration in flue gas is from 8% to 12% by volume, depending upon the carbon/hydrogen ratio and relative humidity in the combustor and moisture content of the flue gas. The moisture content of the flue gas may be increased by returning $Ca(OH)_2$ to the combustor, thereby increasing the moisture in the combustor. By this method, if there is total hydration of CaO in the filter, water is indirectly recycled through the combustor according to the following reactions.

$$CaO + H_2O \rightarrow Ca(OH)_2 \text{ [FILTER]} \quad (5)$$

$$Ca(OH)_2 \rightarrow CaO + H_2O \text{ [COMBUSTOR]} \quad (6)$$

Two limitations restrict the degree of water recycle. As the efficiency of sulfur capture by active lime approaches 100%, there will be less available CaO leaving the combustor in the flue gas. Also, although highly unlikely, the presence of a large amount of CaO dust in the flue gas would result in a significant amount of energy consumption in the combustor via equation (6), which would possibly affect the operation of the boiler being heated by the combustor. Whether the hydration reaction occurs in the fabric filter or in an external mixer, it has been found that the hydration occurs rapidly and efficiently at a temperature from about 200° F. to about 400° F. Preferably, the hydration reaction may be conducted from 200° F. to 250° F.

The conditions of the hydration reaction are preferably controlled so as not to allow excess water to be in contact with the calcium oxide: calcium sulfate particles thereby causing excess hydration. In practical applications, the avoidance of excess water is not a problem. However, the moisture content of the wet coal may not be sufficiently high to effect the desired degree of hydration and therefore additional water may be needed when the wet coal and dust are mixed as in FIG. 1. This may be accomplished in the case where the dust cake and wet coal are mixed external to the flue gas flow by adding an appropriate amount of water to the mixer. In the above embodiments wherein the hydration reaction occurs on the filter fabric, the amount of moisture taken up by the calcium oxide may be controlled by the time of exposure to the moist flue gas.

Other objects and advantages of the invention will be made apparent from the accompanying drawings in which.

Figure 1:
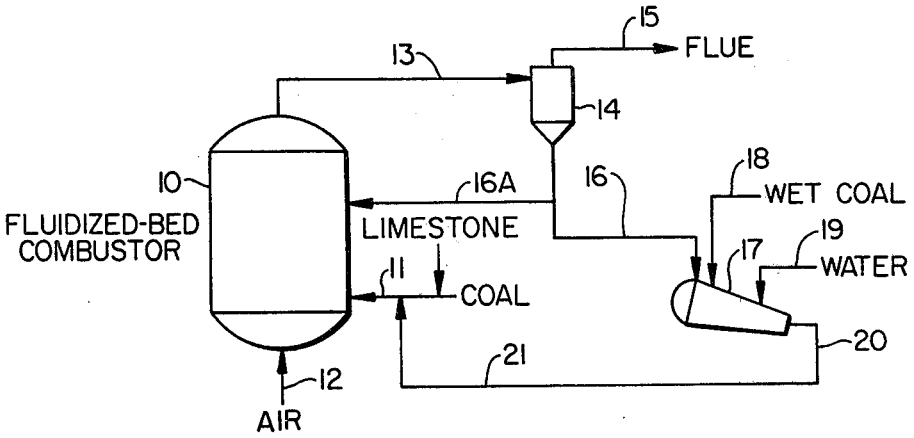
FIG. 1 is the schematic illustration of the process of the invention whereby the dust cake from the bag house is either mixed with wet coal or directly fed into the combustor.

Referring to FIG. 1, there is shown a schematic illustration of the preferred embodiment of the process of the present invention. The fluidized bed combustor 10 is shown wherein the coal and limestone makeup is fed through line 11 and air is fed through line 12. The combustor 10 is of conventional design and may be maintained at temperatures from 800° F. to 2000° F. and at pressures from 1 to 10 atmospheres. Combustion gases and fly ash are passed by line 13 to a bag house 14, preferably containing a fabric filter (not shown). The gaseous components, depleted in water vapor, exit from the bag house through line 15 to the stack. The dust cake containing partially sulfated lime is fed through line 16 into mixer 17 where it is mixed with crushed wet coal which enters through line 18. Alternatively, the dust cake is fed through line 16A into combustor 10. The mixer 17 is maintained at a temperature of about 200° F. to 400° F. in order to effect the optimum conditions for hydration. Additional water for hydration, if needed, is fed into the mixer through line 19. The hydrated calcium oxide (calcium hydroxide) and dry coal mix exits the mixer through line 20 and is fed through line 21 into combustor 10.

Figure 2:
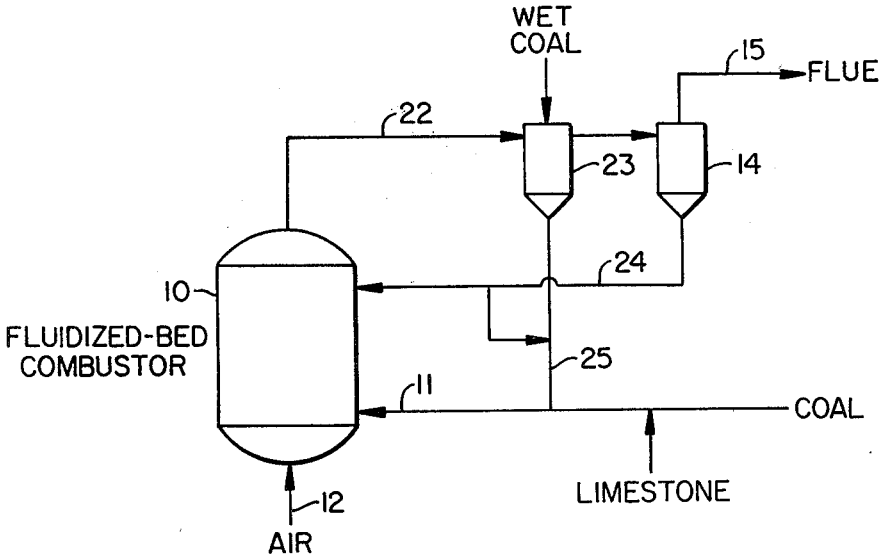
FIG. 2 is a schematic illustration of a further embodiment of the process of the invention whereby moisture is provided by wet coal upstream from the bag house.

Referring to FIG. 2, there is shown a schematic illustration of another embodiment of the process according to the present invention. The combustion gases and fly ash are passed from line 22 into dryer 23 containing crushed wet coal. The moisture-containing flue gases then pass into bag house 14, preferably containing a fabric filter (not shown) which collects the partially sulfated lime particles as well as coal fines and ash. The filtered flue gas exits the bag house through line 15 to the stack. The bag house 14 is maintained at a temperature from about 200° F. to 400° F. by a cooling means (not shown), always included in a power boiler, such as convection bank, economizer and air heater, since temperatures of these apparatus are well below the temperature of the flue gas exiting the combustor. The partially hydrated calcium oxide is maintained on the filter fabric in bag house 14 for a period of time sufficient to complete the desired hydration reaction. The flowable filter cake is then recycled through line 24 into the combustor. The flowable filter cake may alternatively be mixed with the dry crushed coal in line 25 and recycled into the combustor.

In another embodiment, the bag house 14 in FIG. 2 may be eliminated providing that the passage of flue gas through dryer 23 is designed such that the coal therein serves as a filtering means. The dry coal and particles collected thereby may then be recycled into combustor 10 via lines 25 and 11.

The process of the invention is further described in the following experimental examples.

EXAMPLE 1

Figure 3A:
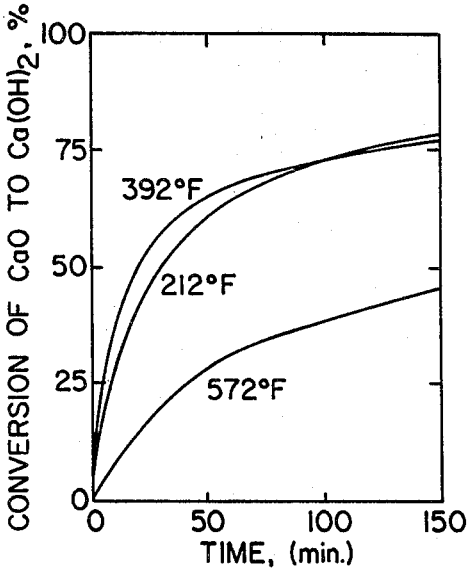
FIG. 3 is a graphic comparison of the hydration rates of two spent limestone sorbents.
Figure 3B:
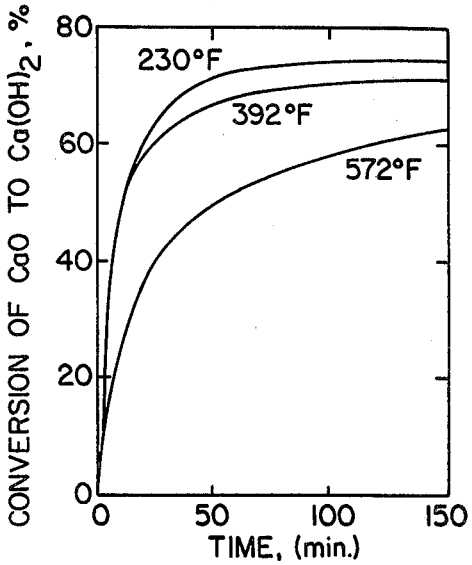

The rate of hydration of spent sorbent was studied on a laboratory apparatus wherein air and water streams, controlled with rotameters, enter a boiler. From the boiler the air stream mixture travels through a heated line to a basket which may hold a 3 to 5 gram sample of spent sorbent. The sample-containing basket is suspended from a recording balance and is kept at temperature with an annular furnace. The balance provides a continuous record of weight increase as water is absorbed by the sample. Referring to FIG. 3, two spent limestone sorbents were exposed to a 12% water vapor at temperatures of 212° F., 230° F., 392° F. and 572° F. The sorbent in FIG. 3(*a*) contained 60% sulfur. The sorbent in FIG. 3(*b*) contained 2.1% sulfur. In both cases it can be seen that conversion of calcium oxide to $Ca(OH)_2$ was the fastest and most efficient at the temperatures of 230° F. and 392° F.

EXAMPLE 2

Figure 4:
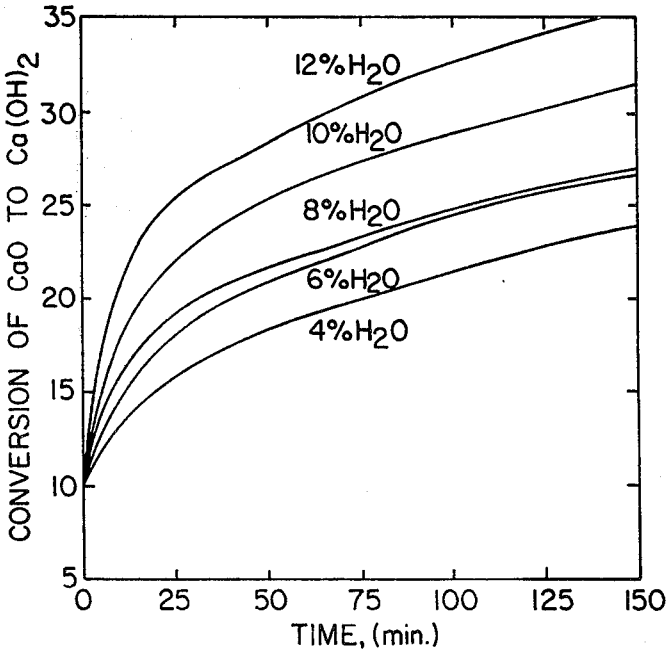
FIG. 4 is a graphic comparison of hydration rates of a spent sorbent at various water vapor concentrations.

Using the apparatus described in Example 1, a sample of spent sorbent containing 8% sulfur was hydrated at 392° F. by exposure to different concentrations of water vapor. The results are shown in FIG. 4. The figure shows that the hydration rate is rapid for approximately the first half hour, after which time the hydration rate significantly decreases. Fabric filters are readily designed in which the collected dust cake has an average particle residence time of 30 minutes or longer.

EXAMPLE 3

Figure 5:
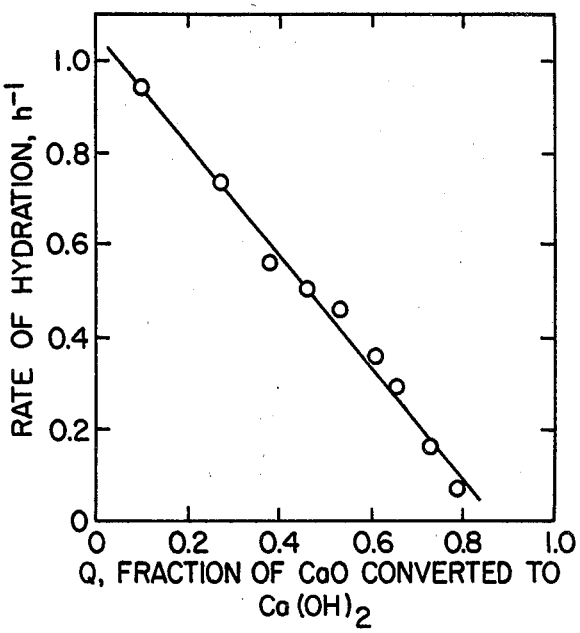
FIG. 5 is a graphic comparison of hydration rates of a spent sorbent as the fraction of calcium oxide to calcium hydroxide conversion increases.

It was expected that the rate of water vapor absorption would be proportional to (1-Q), where Q is the fraction of calcium oxide converted to calcium hydroxide. FIG. 5 shows the rates obtained by measuring the slope of the weight increase curve during the hydration run on the apparatus in Example 1 using a spent sorbent containing 60% sulfur in 12% water vapor at 230° F. The results confirmed that the rate of hydration is proportional to (1-Q). It may be seen that if the flue gas contains 8% water and if half of this is absorbed by CaO and recycled, then the moisture in resultant flue gas would rapidly approach 12%.

EXAMPLE 4

Figure 6:
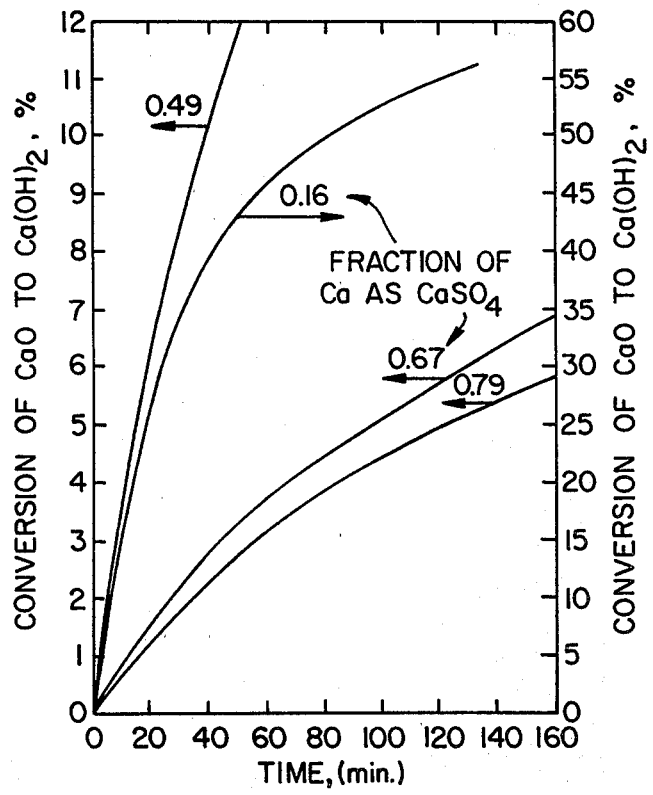
FIG. 6 is a graphic comparison of calcium oxide hydration rates in spent sorbents containing various calcium sulfate fractions.

It was expected that the rate of hydration would be affected by the fraction of calcium which had been converted to calcium sulfate. The calcium sulfate forms on the particle surfaces exterior to the calcium oxide and may be a barrier to the diffusion of water vapor into the calcium oxide. Samples of a spent sorbent taken from a combustor run which contained differing calcium sulfate fractions were hydrated with a 12% water vapor at 392° F. The results are shown in FIG. 6. FIG. 6 shows that the less sulfated material was hydrated much more rapidly than the more extensively sulfated material.

Figure 7:
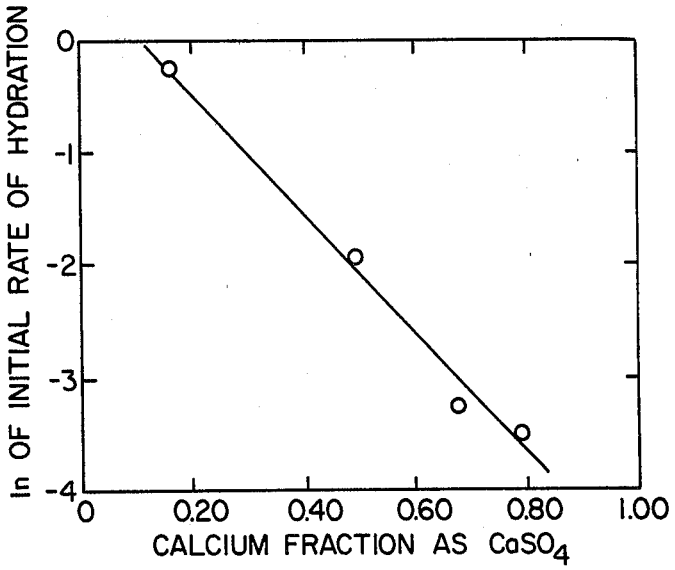
FIG. 7 is a graphic partial logarithmic conversion of the data in FIG. 6.

FIG. 7 shows that the relationship between rate of hydration and fraction of calcium sulfate may be logarithmic.

The experiments described in the above Examples were conducted by the Argonne National Laboratory and published in Report Series ANL/CEN/FE-80-7.

It will be realized that many variations of the above-described embodiments and examples demonstrating the instant invention will be readily apparent to one skilled in the art. However, this invention is not to be limited except by the scope of the following claims.

What is claimed is:

1. A method for improving the sulfur capture potential of lime in the fluidized bed combustion of coal and for improving the flow characteristics of the feed coal thereto comprising:

(a) introducing the gas from fluidized bed combustion of coal which contains particles comprising calcium oxide into a filtering means whereby said particles are collected;

(b) mixing said particles with wet coal at a temperature from about 200° F. to about 400° F., thereby drying said coal and hydrating said calcium oxide to form calcium hydroxide;

(c) introducing the mixture from step (b) into said fluidized bed combustor.

2. A method according to claim 1 wherein an amount of water is added to said mixture from step (b) sufficient to complete the conversion of calcium oxide to calcium hydroxide.

3. A method according to claim 1 wherein said temperature is from about 200° F. to 250° F.

4. A method for improving the sulfur capture potential of lime in the fluidized bed combustion of coal and for improving the flow characteristics of the coal feed therefor comprising:

(a) contacting wet coal with gas from fluidized bed combustion of coal thereby drying said coal;

(b) conducting the moisture-containing gas resulting from step (a) into a filtering means whereby particles in said gas comprising calcium oxide are collected;

(c) exposing said collected particles to said moisture containing gas at a temperature from about 200° F. to 400° F., thereby hydrating said calcium oxide to form calcium hydroxide;

(d) introducing the particles from step (c) and the coal from step (a) into said fluidized bed combustor.

5. A method according to claim 4 wherein in step (d) said particles and coal are mixed prior to introduction into said combustor.

6. A method according to claim 4 wherein in step (d) said particles and said coal are separately introduced into said combustor.

7. A method according to claim 4 wherein in step (b) said filtering means comprises said coal in step (a).

8. A method according to claim 4 wherein in step (b) said filtering means comprises a fabric filter.

9. A method according to claim 8 wherein said temperature is from about 200° F. to 250° F.

10. A method for improving the sulfur capture potential of lime in the fluidized bed combustion of coal comprising:

(a) introducing moisture-containing gas from fluidized bed combustion of coal which contains particles comprising calcium oxide into a filtering means whereby said particles are collected;

(b) retaining said collected particles on said filtering means at a temperature from about 200° F. to 400° F. for a period of time sufficient to substantially hydrate said calcium oxide to form calcium hydroxide;

(c) introducing the product from step (b) into said fluidized bed combustor.

11. A method according to claim 10 wherein said particles are retained on said filtering means in step (b) for longer than 30 minutes.

* * * * *